US011572681B2

(12) United States Patent
Maruyama et al.

(10) Patent No.: US 11,572,681 B2
(45) Date of Patent: Feb. 7, 2023

(54) FLUSH TOILET

(71) Applicant: TOTO LTD., Kitakyushu (JP)

(72) Inventors: Takahiro Maruyama, Kitakyushu (JP); Wataru Ishimi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/679,794

(22) Filed: Feb. 24, 2022

(65) Prior Publication Data

US 2022/0275619 A1 Sep. 1, 2022

(30) Foreign Application Priority Data

Feb. 26, 2021 (JP) ..... JP2021-030140

(51) Int. Cl.
*E03D 11/02* (2006.01)

(52) U.S. Cl.
CPC ..... *E03D 11/02* (2013.01)

(58) Field of Classification Search
CPC ..... E03D 1/26; E03D 11/13; E03D 11/02
See application file for complete search history.

(56) References Cited

U.S. PATENT DOCUMENTS

2017/0370086 A1* 12/2017 Momoe ..... E03D 5/01

FOREIGN PATENT DOCUMENTS

| | | | |
|---|---|---|---|
| JP | 2014-114632 | A | 6/2014 |
| JP | 2017-89282 | A | 5/2017 |
| JP | 2020-165170 | A | 10/2020 |

* cited by examiner

*Primary Examiner* — Janie M Loeppke
(74) *Attorney, Agent, or Firm* — BakerHostetler

(57) ABSTRACT

A flush toilet includes a toilet main body made of ceramics and a rear storage configured to store at least a part of a control unit. The rear storage includes a supporting wall that divides a storage region into upper and lower regions and that joins left and right side walls of the skirt and the water discharge trap. The supporting wall includes a horizontal wall that extends in a horizontal direction from a joining portion between the supporting wall and the water discharge trap, and left and right lower walls that are provided outside the horizontal wall in a left-right direction and below the horizontal wall and that are joined to the left and right side walls of the skirt. The left and right lower walls on a rear side are separated in the left-right direction by the horizontal wall.

5 Claims, 11 Drawing Sheets

FLUSH TOILET

CROSS REFERENCE TO RELATED APPLICATION

This application claims benefit of priority to Japanese Patent Application No. 2021-030140, filed on Feb. 26, 2021, the entire content of which is incorporated herein by reference.

FIELD OF THE INVENTION

The present invention relates to a flush toilet, and more particularly, to a flush toilet which is flushed with flush water to discharge waste.

BACKGROUND OF THE INVENTION

Conventionally, as a flush toilet which is flushed with flush water to discharge waste, there is known, for example, as described in Patent Document 1 (Japanese Patent Laid-Open No. 2014-114632) and Patent Document 2 (Japanese Patent Laid-Open No. 2017-89282), a so-called "full skirt" or "total Hakama" flush toilet in which a skirt formed on an outer side than a side surface of each of a bowl of a toilet main body made of ceramics and a water discharge trap is formed all around the toilet main body, and formed seamlessly in terms of desirability of the toilet main body. In this conventional "full skirt" or "total Hakama" flush toilet, a storage section that is available for storing a control unit including a function of controlling discharging and stopping of flush water to the bowl of the toilet main body is provided in a region more rearward than the bowl of the toilet main body, and four sides of this storage section is surrounded with ceramics.

Also, in the conventional flush toilet described in Patent Document 1, the storage section that is available for storing the control unit provided more rearward than the bowl of the toilet main body has left, right and rear sides surrounded with the skirt. Further, in this storage section, a supporting wall that supports the control unit extends substantially horizontally from a joining portion between the supporting wall and a discharge trap to the skirt on the left and right sides, to acquire strength of the storage section, and to acquire a storage region above the horizontal supporting wall in the storage section. Similarly, in the conventional flush toilet described in Patent Document 2, the storage section that is available for storing the control unit provided more rearward than the bowl of the toilet main body has left, right and rear sides surrounded with the skirt. In this storage section, a supporting wall that supports the control unit includes a horizontal wall that substantially horizontally protrudes leftward, rightward and rearward from a joining portion between the supporting wall and a water discharge trap, a stepped portion that descends from left, right and rear ends of the horizontal wall, and a lower wall that is joined to this stepped portion and that is provided below the horizontal wall. Additionally, the lower wall of the supporting wall is formed in a region from the stepped portion to outside the water discharge trap in a left-right direction and behind the water discharge trap. Furthermore, in a conventional flush toilet described in Patent Document 3 (Japanese Patent Laid-Open No. 2020-165170), a storage section that is available for storing a control unit provided more rearward than a bowl of a toilet main body has left, right and rear sides that are not surrounded with a skirt made of ceramics and that are open. Also, in this storage section, a supporting wall that supports the control unit is provided, and the supporting wall includes a horizontal wall that substantially horizontally protrudes from a joining portion between the supporting wall and a water discharge trap. Further, a descending stepped portion is provided on left and right sides of the horizontal wall.

On the other hand, one of aims that have been requested to be achieved in recent years with design diversification of the flush toilet and improvement in design such as appearance of the flush toilet is to acquire a large storage region that stores a control unit in a region more rearward than a bowl of a toilet main body, while reducing (slimming) an external dimension of the whole toilet main body. Particularly, in the so-called "full skirt" or "total Hakama" flush toilet, as a larger storage region of the storage section that is provided more rearward than the bowl of the toilet main body to store the control unit is acquired, there is concern about lack of strength, and hence one of requested aims is to increase strength of the whole toilet main body while also increasing strength of the storage section. However, in the conventional flush toilet described in Patent Document 1, in the storage section of the control unit that is provided more rearward than the bowl of the toilet main body, the supporting wall that supports the control unit simply extends substantially horizontally from the joining portion between the supporting wall and the discharge trap to the skirt on the left, right and rear sides. Consequently, there is a problem that the storage region is limited to a region above the substantially horizontal supporting wall and that it is difficult to acquire the storage region in a region below the horizontal supporting wall or the like. Also, in the conventional flush toilet described in Patent Document 2 in which the supporting wall that supports the control unit in the storage section of the control unit includes the horizontal wall, the stepped portion, and the lower wall, as compared with the conventional flush toilet described in Patent Document 1, a larger storage region of the control unit can be acquired. In the conventional flush toilet described in Patent Document 2, however, the lower wall of the supporting wall is widely formed in the region outside the water discharge trap in the left-right direction and behind the water discharge trap. Consequently, there is concern about lack of strength, and there is a problem that the whole toilet main body might increase in size to make up for the lack of strength. Furthermore, in the conventional flush toilet described in Patent Document 3, the left, right and rear sides of the storage section of the control unit are not surrounded with the skirt made of ceramics, and hence there is a problem that this flush toilet has insufficient strength compared to the full skirt flush toilet.

Accordingly, the present invention is aimed at solving problems of the conventional arts described above and is aimed at providing a flush toilet in which a large storage section of a control unit in a toilet main body can be acquired, and strength of the whole toilet main body can be increased, while suppressing an external dimension of the whole toilet main body.

SUMMARY OF THE INVENTION

To solve the problems described above, an aspect of the present invention is a flush toilet comprising: a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side of side surfaces of the bowl and the water discharge trap, and a rear storage being provided below an upper end of the skirt and on an inner side than the skirt in a region more rearward than the bowl, the rear storage includes a supporting wall configured to join left and right side walls of the skirt and the water discharge trap so as to divide a storage region into upper and lower regions, the supporting wall includes a horizontal wall and left and right lower walls joined to the left and right side walls of the skirt, and the horizontal wall extends in a horizontal direction from a joining portion between the supporting wall and the water discharge trap, and the left and right lower walls are provided outside the horizontal wall in a left-right direction and below the horizontal wall, and each rear side of the left and right lower walls is separated in the left-right direction by the horizontal wall. According to the aspect of the present invention having this configuration, the supporting wall that divides the storage region of the rear storage of the toilet main body made of ceramics into upper and lower regions can join the left and right side walls of the skirt and the water discharge trap. More specifically, the horizontal wall of the supporting wall of the rear storage is joined to the water discharge trap. Additionally, the lower walls provided outside the horizontal wall in the left-right direction and below the horizontal wall are joined to the left and right side walls of the skirt, and the left and right lower walls on the rear side are separated in the left-right direction by the horizontal wall. Therefore, the horizontal wall of the supporting wall can sufficiently support the water discharge trap from the horizontal direction, and the left and right lower walls of the supporting wall can sufficiently support the left and right side walls of the skirt from inside in the left-right direction. Consequently, a region above the supporting wall (the horizontal wall and the lower wall) in the rear storage can be acquired as a comparatively large storage region, and strength of the whole toilet main body made of ceramics can increase.

In the aspect of the present invention, preferably, the water discharge trap includes the inlet below the bowl, and an exit provided more rearward than the inlet, and the horizontal wall includes a discharge trap vicinity region and a rear region, and the discharge trap vicinity region is provided behind and on opposite left and right sides of a discharge core that is a center of an exit side conduit in at least the water discharge trap, and the rear region is provided behind the discharge trap vicinity region and the water discharge trap. According to the aspect of the present invention having this configuration, an exit side of the water discharge trap of the toilet main body is away from the inlet of the water discharge trap that is connected to below the bowl, and the exit side is therefore generally a portion having strength that is likely to be insufficient. To solve this problem, in the aspect of the present invention, the horizontal wall of the supporting wall of the rear storage is joined to the discharge trap vicinity region provided behind and on the opposite left and right sides of the discharge core that is the center of the exit side conduit in at least the water discharge trap, and the horizontal wall is also provided in the rear region behind the discharge trap vicinity region and the water discharge trap. Consequently, strength of the exit side and a peripheral portion in the water discharge trap can increase, and lack of strength can be eliminated from the whole water discharge trap and the rear storage. Therefore, a region above the discharge trap vicinity region and the rear region of the water discharge trap in the horizontal wall of the supporting wall of the rear storage can be acquired as a comparatively large storage region, and strength of the toilet main body made of ceramics can increase.

In the aspect of the present invention, preferably, the skirt includes a rear wall provided on a back surface of the toilet main body, the horizontal wall has a front side joined to a rear side of the water discharge trap, and the horizontal wall has a rear side joined to the rear wall of the skirt. According to the aspect of the present invention having this configuration, the front side of the horizontal wall of the supporting wall of the rear storage is joined to the rear side of the water discharge trap, and the rear side of the horizontal wall is joined to the rear wall of the skirt, so that the front side of the horizontal wall of the supporting wall can sufficiently support the water discharge trap from the rear side, and the rear side of the horizontal wall of the supporting wall can sufficiently support the rear wall of the skirt from the front side. Therefore, a region above the supporting wall (the horizontal wall and the lower wall) in the rear storage can be acquired as a comparatively large storage region, and strength of the rear storage of the toilet main body made of ceramics, the water discharge trap or the like can increase.

In the aspect of the present invention, preferably, the rear wall of the skirt includes an opening penetrating the rear wall in a front-rear direction to communicate between the rear storage and outside of the toilet main body, the horizontal wall includes a rear horizontal wall provided on the rear side of the horizontal wall, the rear horizontal wall being joined to the rear wall of the skirt, and a width of the rear horizontal wall in a left-right direction is larger than a maximum width of the opening in the left-right direction. According to the aspect of the present invention having this configuration, the opening in the rear wall of the skirt and a peripheral portion of the opening are likely to decrease in strength due to a space of the opening and are thus likely to cause deformation such as distortion. However, in the aspect of the present invention, the width of the rear horizontal wall in the left-right direction that is joined to the rear wall of the skirt is set to be larger than the maximum width of the opening in the left-right direction, so that the deformation, such as the distortion, can be suppressed in the opening in the rear wall of the skirt or the peripheral portion of the opening. Also, a larger size of the opening in the rear wall of the skirt can be acquired, while suppressing decrease in strength of the water discharge trap.

In the aspect of the present invention, preferably, the horizontal wall includes a horizontal main wall and a horizontal auxiliary wall, the horizontal main wall being provided to extend rearward from a rear side of the discharge core in the water discharge trap, and the horizontal auxiliary wall being provided to join a rear end of the horizontal main wall and the rear wall of the skirt, the horizontal main wall is provided in such a manner that left and right side ends of the horizontal main wall are away from the left and right side walls of the skirt in the left-right direction, respectively, and the horizontal auxiliary wall is provided in such a manner that left and right side ends of the horizontal auxiliary wall are joined to the left and right side walls of the skirt in the left-right direction, respectively. According to the aspect of the present invention having this configuration, the horizontal main wall in the horizontal wall of the rear storage of the toilet main body can be provided to extend rearward from the rear side of the discharge core in the water discharge trap, and the horizontal auxiliary wall that joins the rear end of the horizontal main wall and the rear wall of the skirt can be provided. Also, the horizontal main wall can be provided in such a manner that each of the left and right side ends of the horizontal main wall is away from each of the left and right side walls of the skirt, and the horizontal auxiliary wall can be provided in such a manner that each of the left and right side ends of the horizontal auxiliary wall is joined to each of the left and right side walls of the skirt. Consequently, the horizontal main wall can sufficiently support the left, right and rear sides of the water discharge trap, and the horizontal auxiliary wall can sufficiently support the horizontal main wall to the rear wall and side walls of the skirt. Furthermore, the horizontal wall (the horizontal main wall and the horizontal auxiliary wall) of the supporting wall in the rear storage can acquire a region on opposite left and right sides of the horizontal main wall and above the lower wall as a comparatively large storage region.

According to a flush toilet of an aspect of the present invention, a large storage section of a control unit in a toilet main body can be acquired, and strength of the whole toilet main body can be increased, while suppressing an external dimension of the whole toilet main body.

DETAILED DESCRIPTION OF THE PREFERRED EMBODIMENTS

Figure 1:
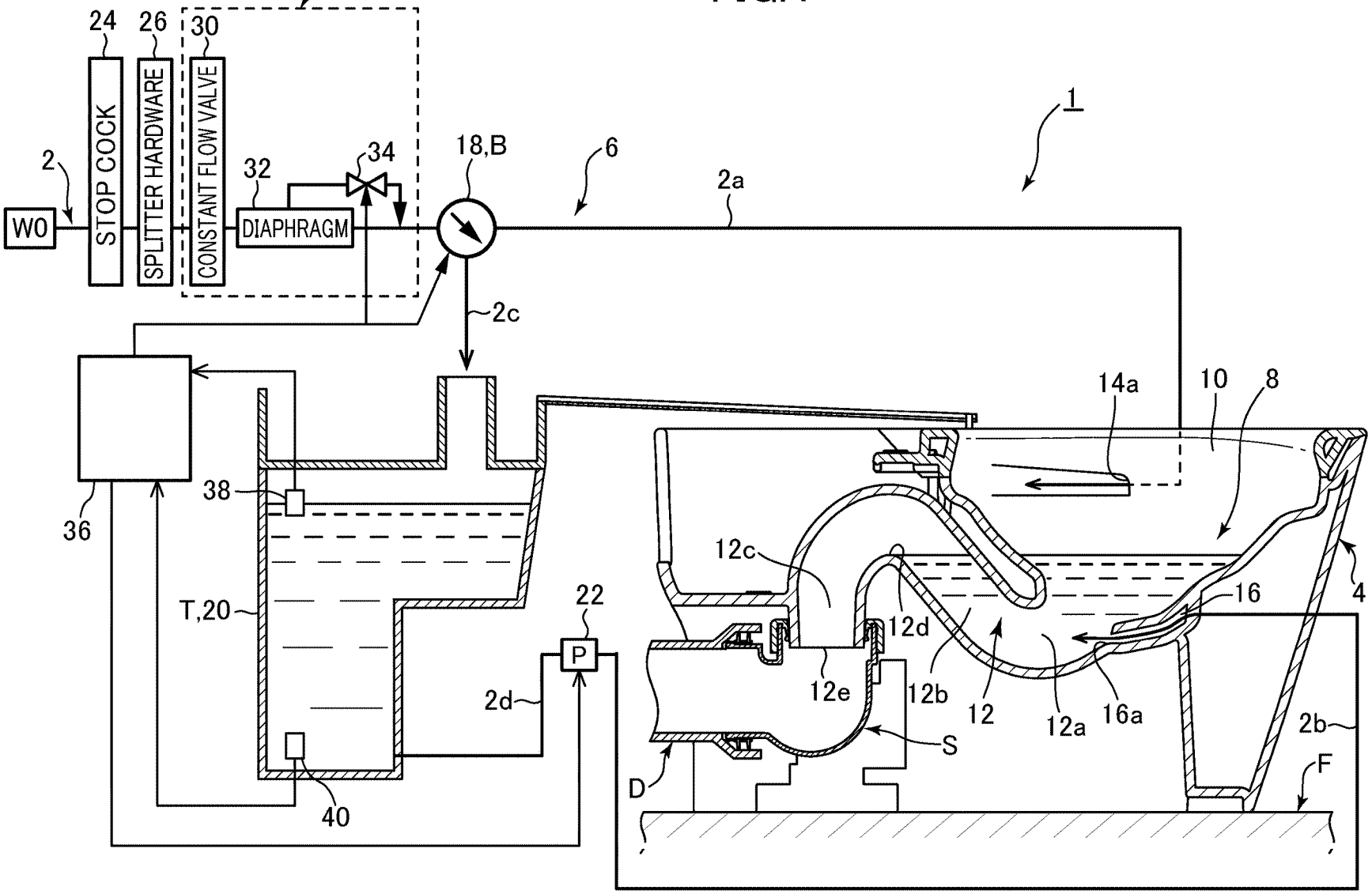
FIG. 1 is an overall structural diagram of a flush toilet according to a first embodiment of the present invention.
Figure 2:
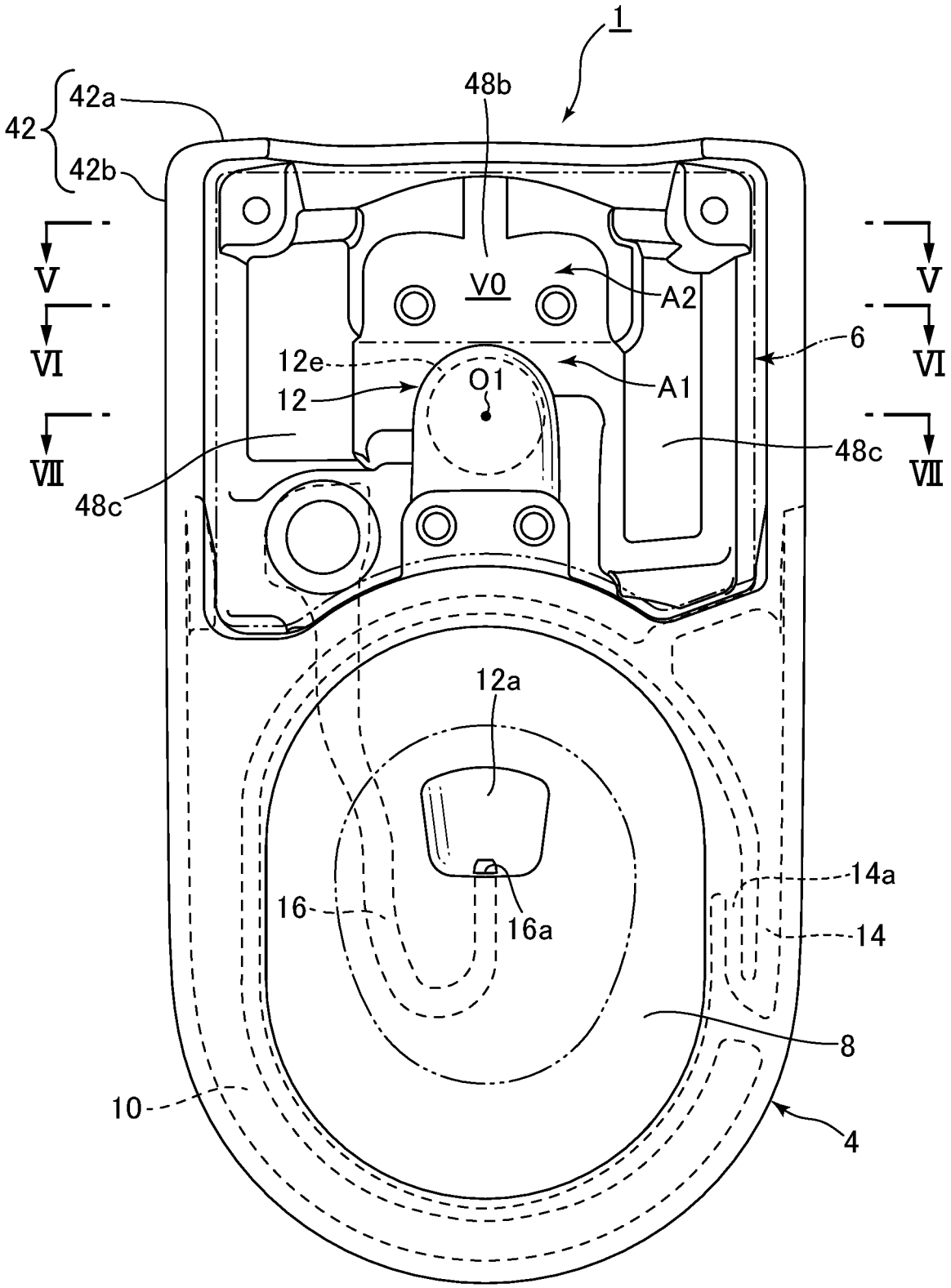
FIG. 2 is a plan view of the flush toilet according to the first embodiment of the present invention.
Figure 3:
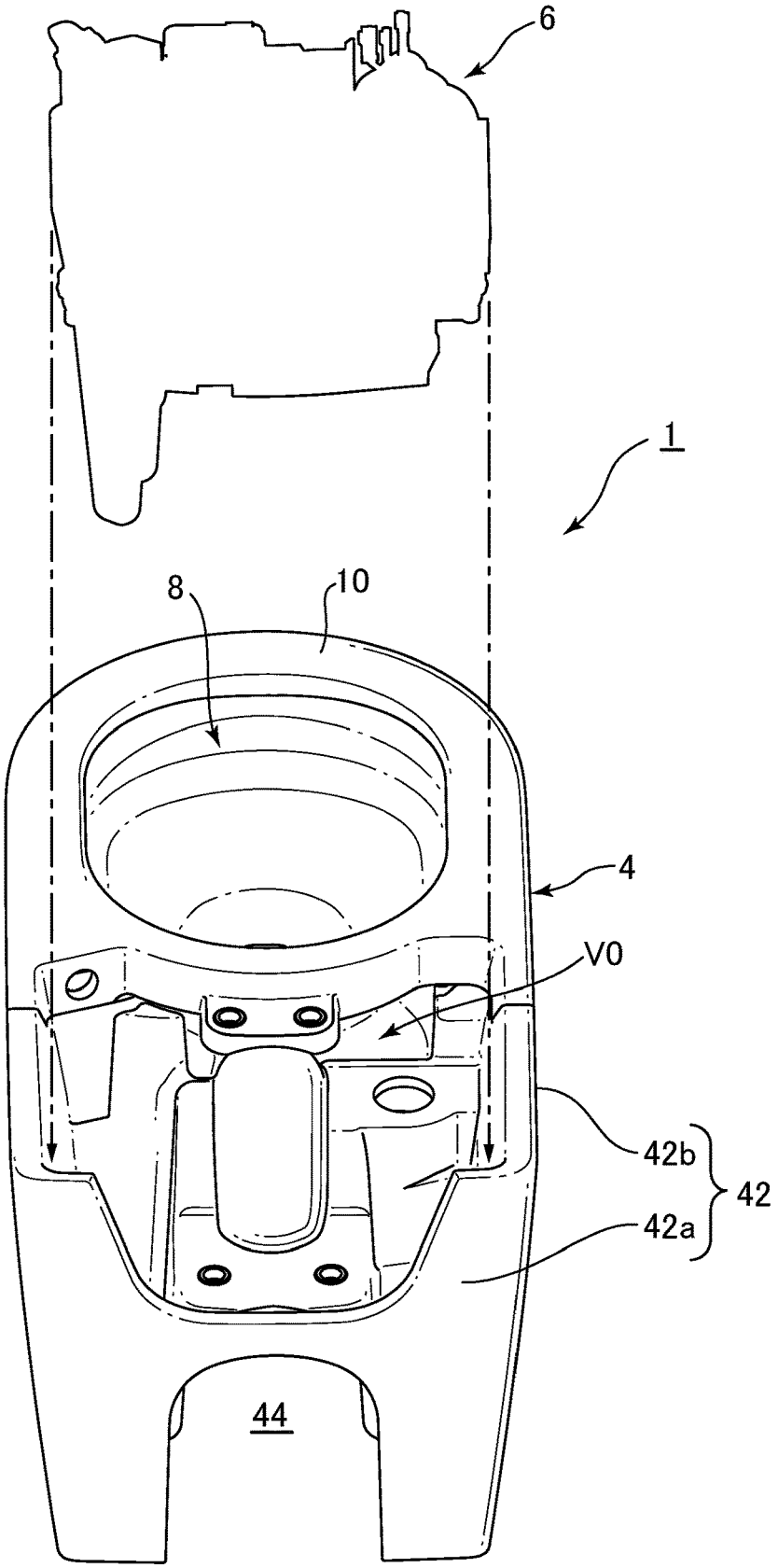
FIG. 3 is an exploded perspective view of the flush toilet according to the first embodiment of the present invention seen from rear and diagonally above.
Figure 4:
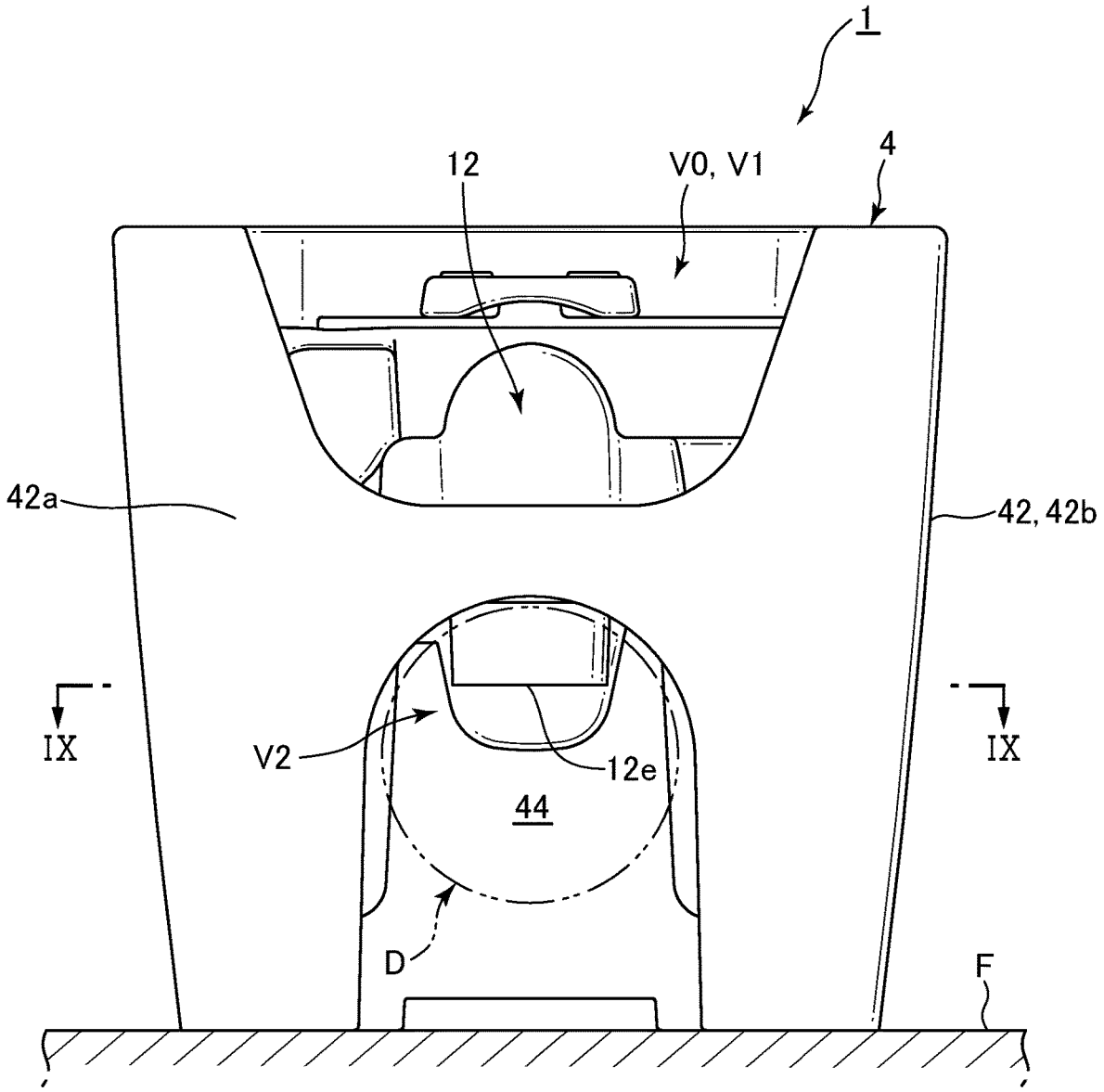
FIG. 4 is a back view of the flush toilet according to the first embodiment of the present invention.

Hereinafter, a flush toilet according to a first embodiment of the present invention will be described with reference to the accompanying drawings. First, an entire configuration of the flush toilet according to the first embodiment of the present invention will be schematically described with reference to FIGS. 1 to 3. As shown in FIGS. 1 to 3, a flush toilet 1 according to the first embodiment of the present invention includes a water supply channel (a main water passageway 2) where flush water that is supplied from a main water supply source WO such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 2, a rim conduit 14 is formed in the rim 10 on one of left and right sides of the toilet main body 4 (right side of the toilet main body 4 seen from front). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front). Further, a rim spout port 14*a* is provided on a downstream end (downstream rear end) of the rim conduit 14. Furthermore, a rim-side water supply channel 2*a* of the flush water supply device 6, of which more later, is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. For its part, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an outlet 12*e* of the descending pipe 12*c* of the water discharge trap 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Consequently, a so-called water discharge mode of "wall side water discharge" is formed where water discharged through the outlet 12*e* of the water discharge trap 12 of the toilet main body 4 is discharged from the discharge socket S to the drain pipe D on a wall side. Additionally, the flush toilet 1 of the present embodiment is not limited to this water discharge mode of "wall side water discharge", and is applicable to a so-called water discharge mode of "floor side water discharge" where water discharged through the outlet 12*e* of the water discharge trap 12 of the toilet main body 4 is discharged from the discharge socket S to a drain pipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, in a mode where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on the downstream side of the branch part B on the downstream side of the main water passageway 2. Accordingly, flush water that is supplied from the main water supply source WO to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 7. Here, the flush toilet 1 of the present embodiment shown in FIGS. 4 to 7 does not show the flush water supply device 6.

First, as shown in FIGS. 2 to 7, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4, to form a storage region that can store at least a part of the flush water supply device 6 (control unit).

Figure 5:
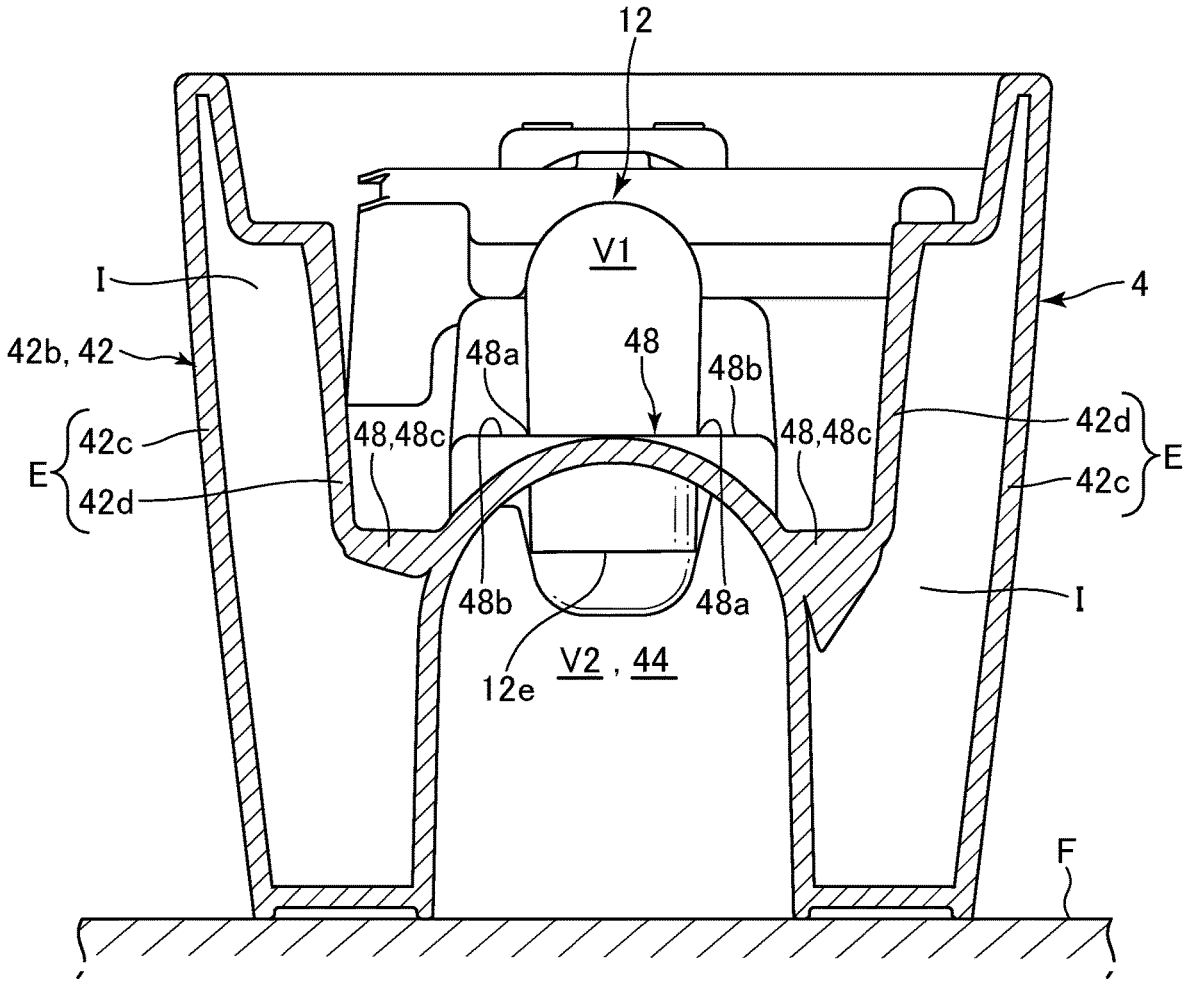
FIG. 5 is a cross-sectional view taken along a line V-V of FIG. 2.
Figure 6:
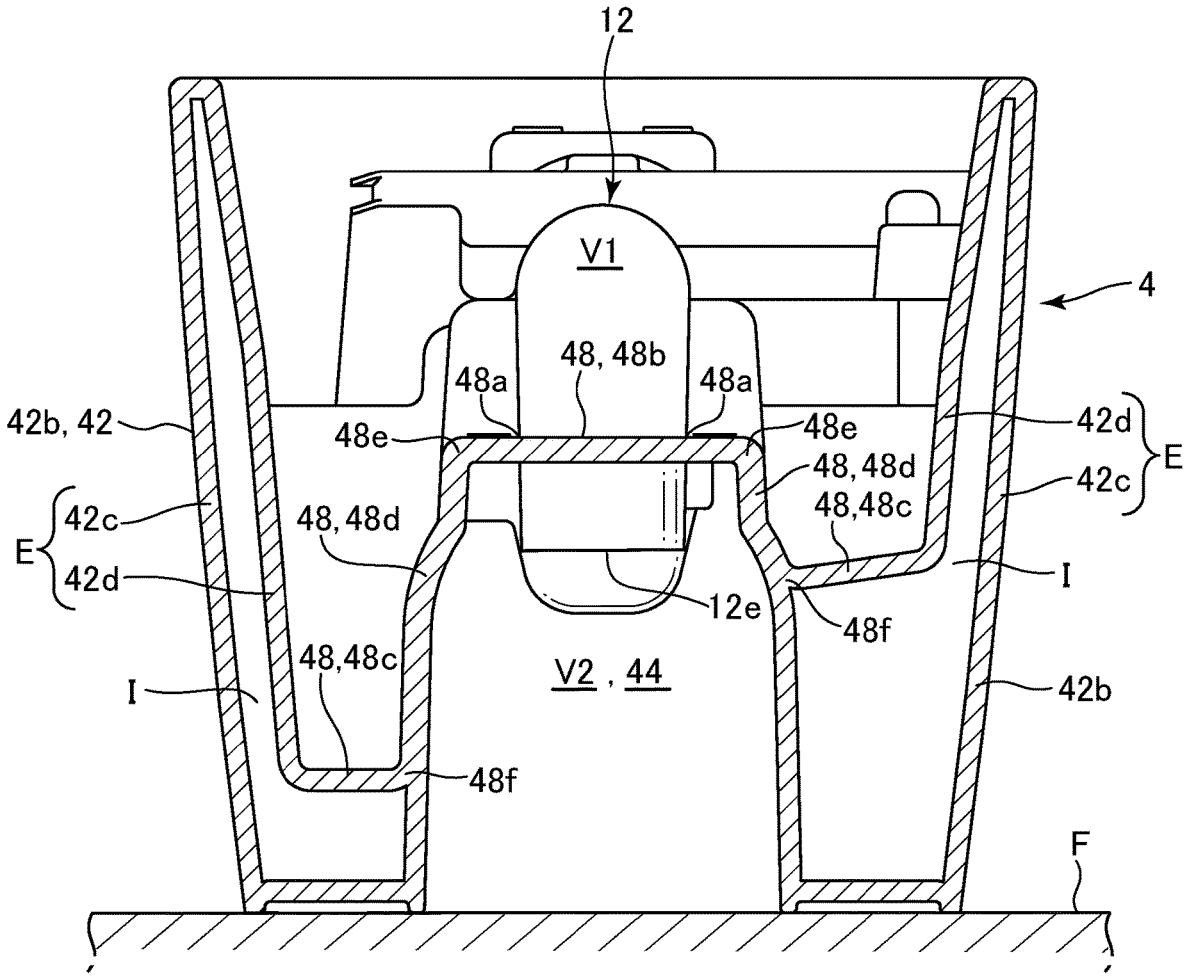
FIG. 6 is a cross-sectional view taken along a line VI-VI of FIG. 2.
Figure 7:
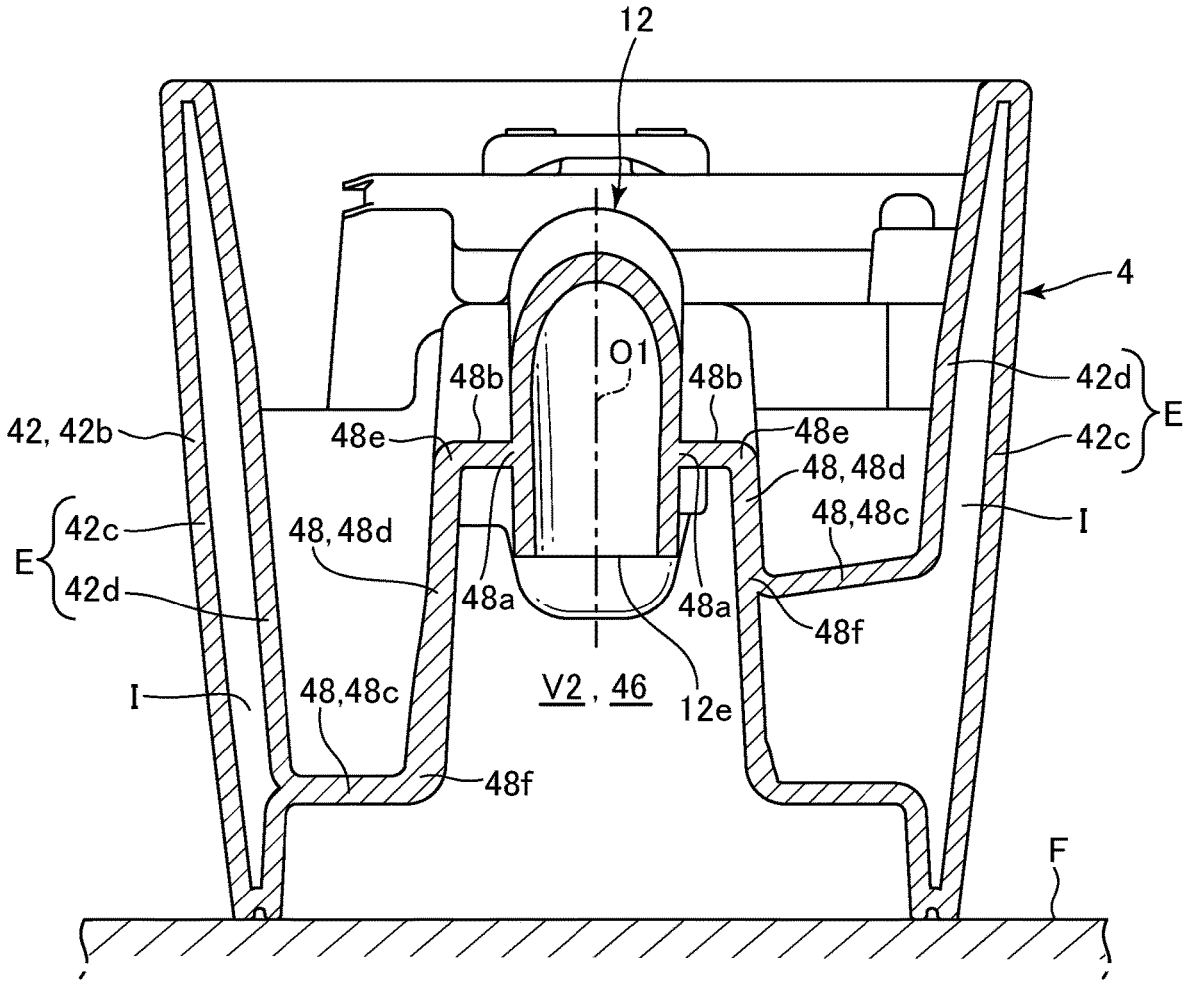
FIG. 7 is a cross-sectional view taken along a line VII-VII of FIG. 2.

Next, as shown in FIGS. 2 to 7, the skirt 42 includes a rear wall 42*a* provided on a back surface of the toilet main body 4, and a side wall 42*b* provided on each of left and right side surfaces of the toilet main body 4 seen from front. Here, as shown in FIGS. 5 to 7, each of the rear wall 42*a* and the side wall 42*b* of the skirt 42 includes an outer wall 42*c* that forms an outer surface of the skirt 42, and an inner wall 42*d* provided inside the outer wall 42*c*. The outer wall 42*c* and the inner wall 42*d* form a double wall portion E. Also, the double wall portion E forms an internal space I between the outer wall 42*c* and the inner wall 42*d*.

Also, an opening 44 to which the drain pipe D is connected is formed to penetrate, in a front-rear direction, a lower portion of a center in a left-right direction seen from front in the rear wall 42*a* of the skirt 42. Furthermore, as shown in FIGS. 4 to 7, a discharge socket storage section 46 is formed on a front side of the opening 44 in a lower region of a center of the rear storage V0 in the left-right direction in the toilet main body 4. The discharge socket storage section 46 functions as a storage region that can store the discharge socket S (see FIG. 1) connected to the outlet 12*e* of the descending pipe 12*c* of the water discharge trap 12.

Next, as shown in FIGS. 5 to 7, the rear storage V0 includes a supporting wall 48 that supports the flush water supply device 6 (control unit). The supporting wall 48 is attached to the water discharge trap 12 and divides, in an up-down direction, a storage region of the rear storage V0 into an upper region V1 and a lower region V2. Also, the upper region V1 of the rear storage V0 includes a storage region that stores at least a part of the flush water supply device 6 (control unit), and the lower region V2 of the rear storage V0 includes an open region of each of the opening 44 and the discharge socket storage section 46.

Next, as shown in FIGS. 2 and 5 to 7, the supporting wall 48 of the rear storage V0 includes a horizontal wall 48*b* that extends in a horizontal direction leftward, rightward and rearward from an attached portion 48*a* to the water discharge trap 12.

Also, the supporting wall 48 includes a lower wall 48*c* provided outside and below the horizontal wall 48*b* in the left-right direction. An outer side of the lower wall 48*c* in the left-right direction is attached to the inner wall 42*d* of the double wall portion E in each of the left and right side walls 42*b* of the skirt 42. Furthermore, the left and right lower walls 48*c* are separated from each other in the left-right direction by the horizontal wall 48*b*, and the left and right lower walls 48*c* and 48*c* are also separated from each other also on a front side and a rear side. Also, between the horizontal wall 48*b* and the lower wall 48*c*, a vertical wall 48*d* that extends in an up-down direction is provided. That is, vertical walls 48*d* are formed to extend downward from upper joining portions 48*e*, joined to left and right outer ends of the horizontal wall 48*b*, to lower joining portions 48*f* joined to left and right inner ends of the lower walls 48*c* and 48*c*, respectively.

Next, as shown in FIG. 2, the horizontal wall 48*b* of the supporting wall 48 includes a discharge trap vicinity region A1 that is provided behind and on opposite left and right sides of a discharge core O1 (see FIGS. 2 and 7) that is a center of an exit 12*e* side conduit in at least the water discharge trap 12. Also, as shown in FIG. 2, the horizontal wall 48*b* of the supporting wall 48 includes a discharge trap rear region A2 that is provided behind the discharge trap vicinity region A1 and the water discharge trap 12.

Next, as shown in FIG. 2, the horizontal wall 48*b* has a front side joined to a rear side of the water discharge trap 12. Also, the horizontal wall 48*b* has a rear side (more specifically, a rear end portion of the horizontal wall 48*b* in a center of a rear side in the left-right direction) joined to the rear wall 42*a* of the skirt 42.

Next, description will be given to operation of the flush toilet 1 according to the first embodiment of the present invention with reference to FIGS. 1 to 7. First, according to the flush toilet 1 of the first embodiment of the present invention, the supporting wall 48 that divides the storage region of the rear storage V0 of the toilet main body 4 made of ceramics up and down into the upper region V1 and the lower region V2 can join the left and right side walls 42*b* of the skirt 42 and the water discharge trap 12. More specifically, the horizontal wall 48*b* of the supporting wall 48 of the rear storage V0 is joined to the water discharge trap 12. Additionally, the lower walls 48*c* provided outside the horizontal wall 48*b* in the left-right direction and below the horizontal wall are joined to the left and right side walls 42*b* of the skirt 42. Also, the left and right lower walls 48*c* on the rear side are separated in the left-right direction by the horizontal wall 48*b*. Consequently, the horizontal wall 48*b* of the supporting wall 48 can sufficiently support the water discharge trap 12 from the horizontal direction, and the left and right lower walls 48*c* of the supporting wall 48 can sufficiently support the left and right side walls 42*b* of the skirt 42 from inside in the left-right direction. Therefore, the region V1 above the supporting wall 48 (the horizontal wall 48*b* and the lower wall 48*c*) in the rear storage V0 can be acquired as a comparatively large storage region, and strength of the whole toilet main body 4 made of ceramics can increase.

Also, according to the flush toilet 1 of the present embodiment, an exit 12*e* side of the water discharge trap 12 of the toilet main body 4 is away from the inlet 12*a* of the water discharge trap 12 that is connected to below the bowl 8, and the exit side is therefore generally a portion having strength that is likely to be insufficient. To solve this problem, in the flush toilet 1 of the present embodiment, the horizontal wall 48*b* of the supporting wall 48 of the rear storage V0 is joined to the discharge trap vicinity region A1 provided behind and on the opposite left and right sides of the discharge core O1 that is the center of the exit 12*e* side conduit in at least the water discharge trap 12, and the horizontal wall is also provided in the rear region A2 behind the discharge trap vicinity region A1 and the water discharge trap 12. Consequently, strength of the exit 12*e* side and a peripheral portion in the water discharge trap 12 can increase, and lack of strength can be eliminated from the whole water discharge trap 12 and the rear storage V0. Therefore, a region above the discharge trap vicinity region A1 and the discharge trap rear region A2 in the horizontal wall 48*b* of the supporting wall 48 of the rear storage V0 can be acquired as a comparatively large storage region, and strength of the toilet main body 4 made of ceramics can increase.

Further, according to the flush toilet 1 of the present embodiment, the front side (discharge trap vicinity region A1) of the horizontal wall 48*b* of the supporting wall 48 of the rear storage V0 is joined to the rear side of the water discharge trap 12, and the rear side (discharge trap rear region A2) of the horizontal wall 48*b* is joined to the rear wall 42*a* of the skirt 42. Consequently, the front side (discharge trap vicinity region A1) of the horizontal wall 48*b* of the supporting wall 48 can sufficiently support the water discharge trap 12 from the rear side, and the rear side of the horizontal wall 48*b* of the supporting wall 48 can sufficiently support the rear wall 42*a* of the skirt 42 from the front side. Therefore, the region V1 above the supporting wall 48 (the horizontal wall 48*b* and the lower wall 48*c*) in the rear storage V0 can be acquired as a comparatively large storage region, and strength of the rear storage V0 of the toilet main body 4 made of ceramics, the water discharge trap 12 or the like can increase.

Next, description will be given to a flush toilet 100 according to a second embodiment of the present invention with reference to FIGS. 8 to 11. Here, in the flush toilet 100 according to the second embodiment of the present invention shown in FIGS. 8 to 11, the same part as the part of the flush toilet 1 according to the first embodiment of the present invention is denoted with the same reference sign, and this is not described. Also, in the flush toilet 100 according to the second embodiment of the present invention shown in FIGS. 9 to 11, the flush water supply device 6 is not shown.

As shown in FIGS. 8 to 11, in the flush toilet 100 according to the second embodiment of the present invention, a supporting wall 148 of a rear storage V100 of a toilet main body 104 includes a horizontal wall 148*b* extending in a horizontal direction from a joining portion 148*a* between the supporting wall and a water discharge trap 112 on opposite left and right sides and a rear side, and a lower wall 148*c* provided outside the horizontal wall 148*b* in a left-right direction and below the horizontal wall. This structure is common to a structure of the horizontal wall 48*b* and the lower wall 48*c* of the supporting wall 48 of the rear storage V0 of the toilet main body 4 in the flush toilet 1 according to the first embodiment of the present invention. Also, in the flush toilet 100 of the present embodiment, the horizontal wall 148*b* of the supporting wall 148 of the rear storage V100 includes a horizontal main wall 150 provided to extend rearward from behind a discharge core O101 in the water discharge trap 112. Further, the horizontal wall 148*b* of the supporting wall 148 of the rear storage V100 includes a horizontal auxiliary wall (rear horizontal wall 152) that is provided on a rear side of the horizontal main wall 150 and that is joined to a rear wall 142*a* of a skirt 142.

Figure 8:
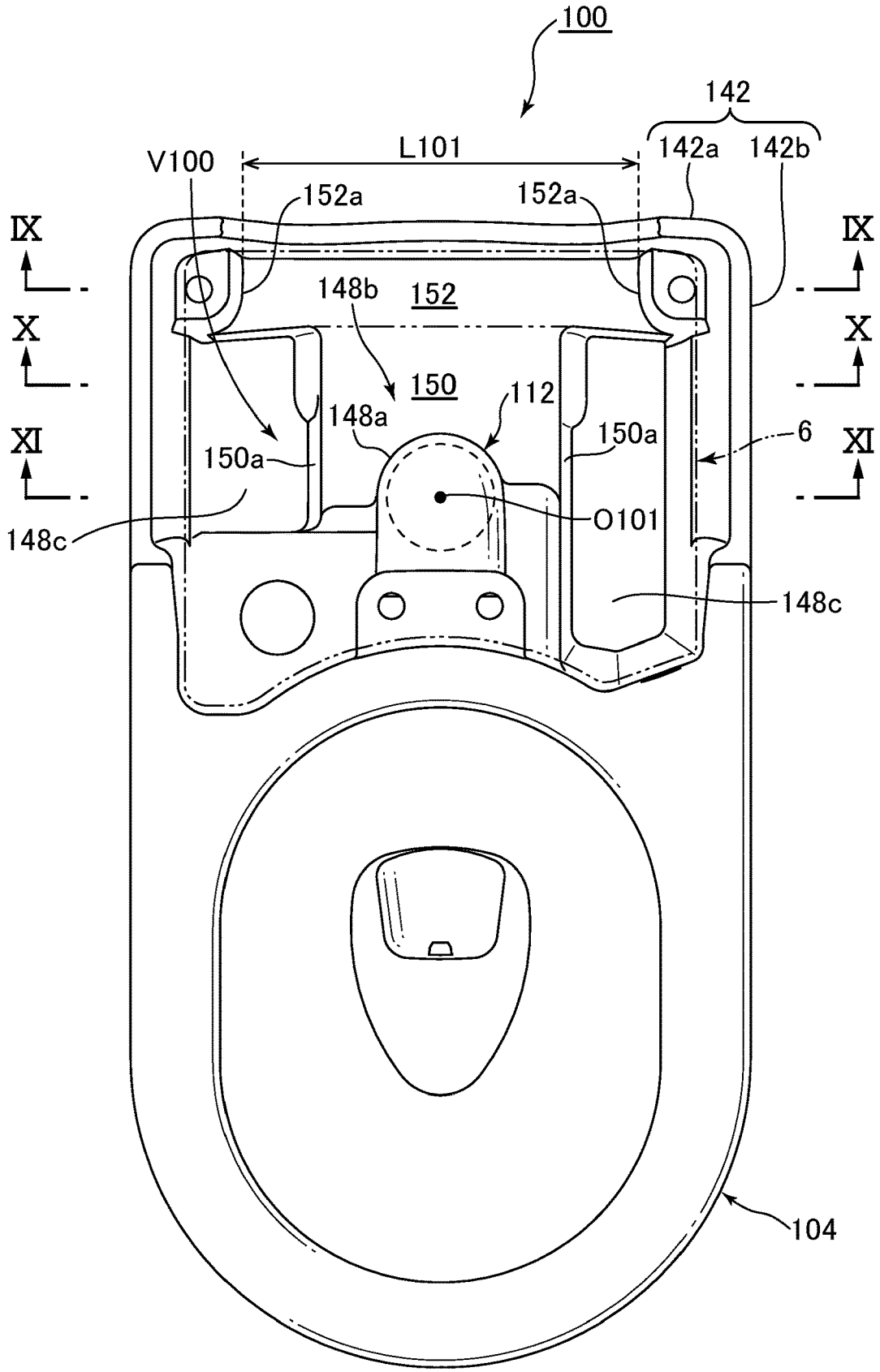
FIG. 8 is a plan view of a flush toilet according to a second embodiment of the present invention.

Also, as shown in FIGS. 8 and 10 to 12, each of left and right side ends 150*a* of the horizontal main wall 150 is provided away from each of left and right side walls 142*b* of the skirt 142 in the left-right direction. On the other hand, as shown in FIGS. 8 and 9, the horizontal auxiliary wall (rear horizontal wall 152) is provided in such a manner that each of the left and right side ends 152*a* is joined to each of left and right side walls 142*b* of the skirt 142 in the left-right direction.

Figure 9:
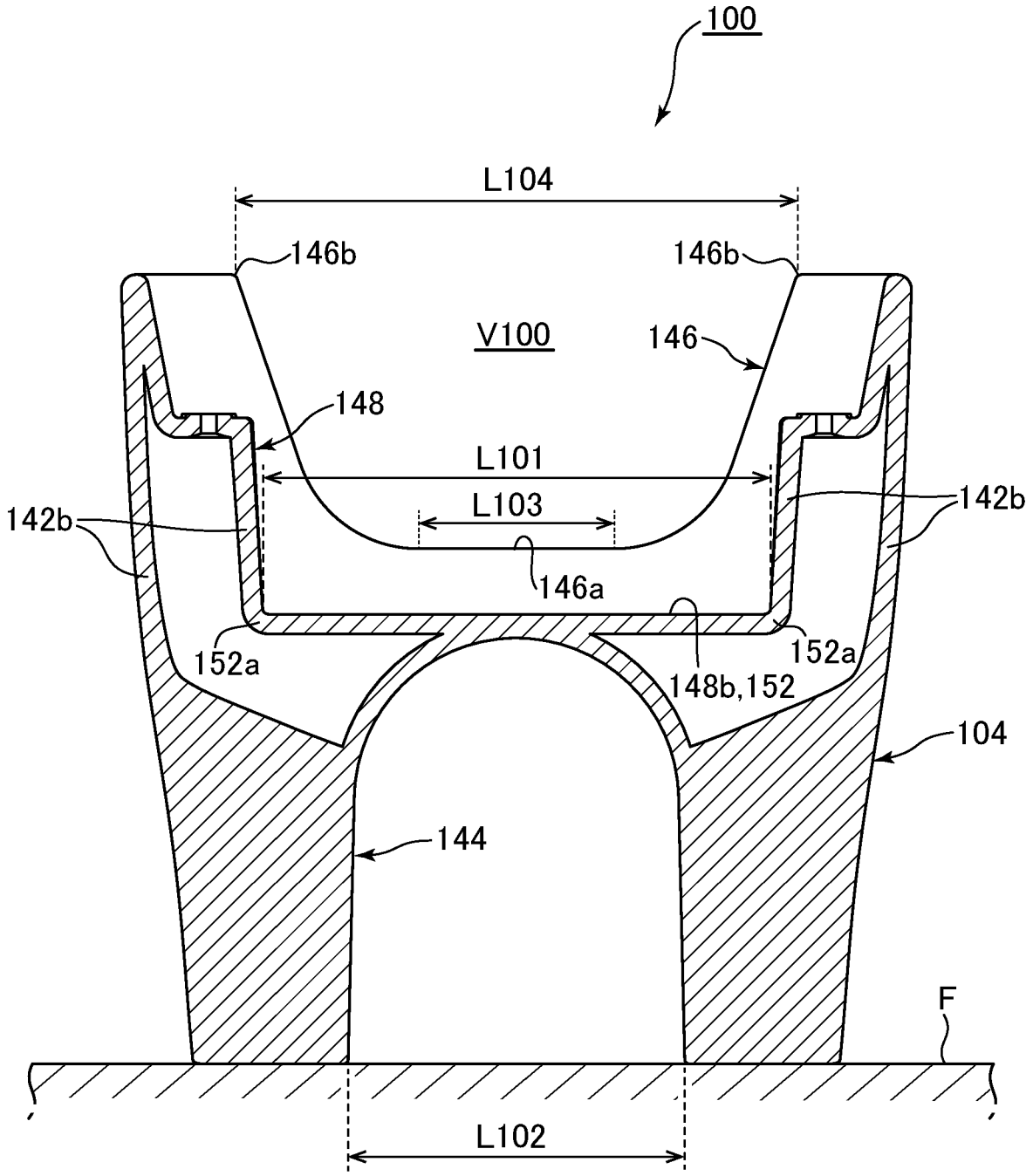
FIG. 9 is a cross-sectional view taken along a line IX-IX of FIG. 8.
Figure 10:
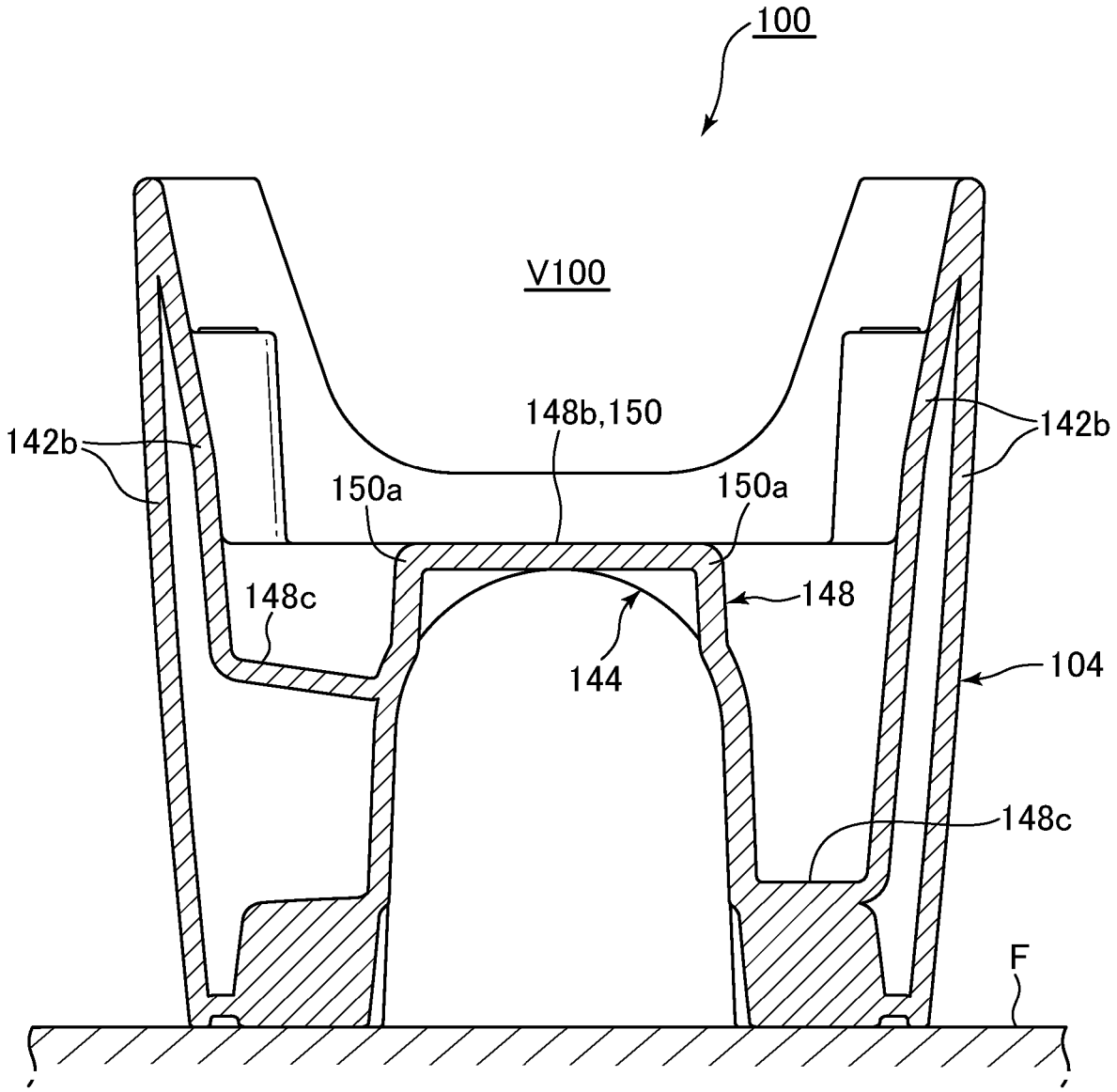
FIG. 10 is a cross-sectional view taken along a line X-X of FIG. 8.
Figure 11:
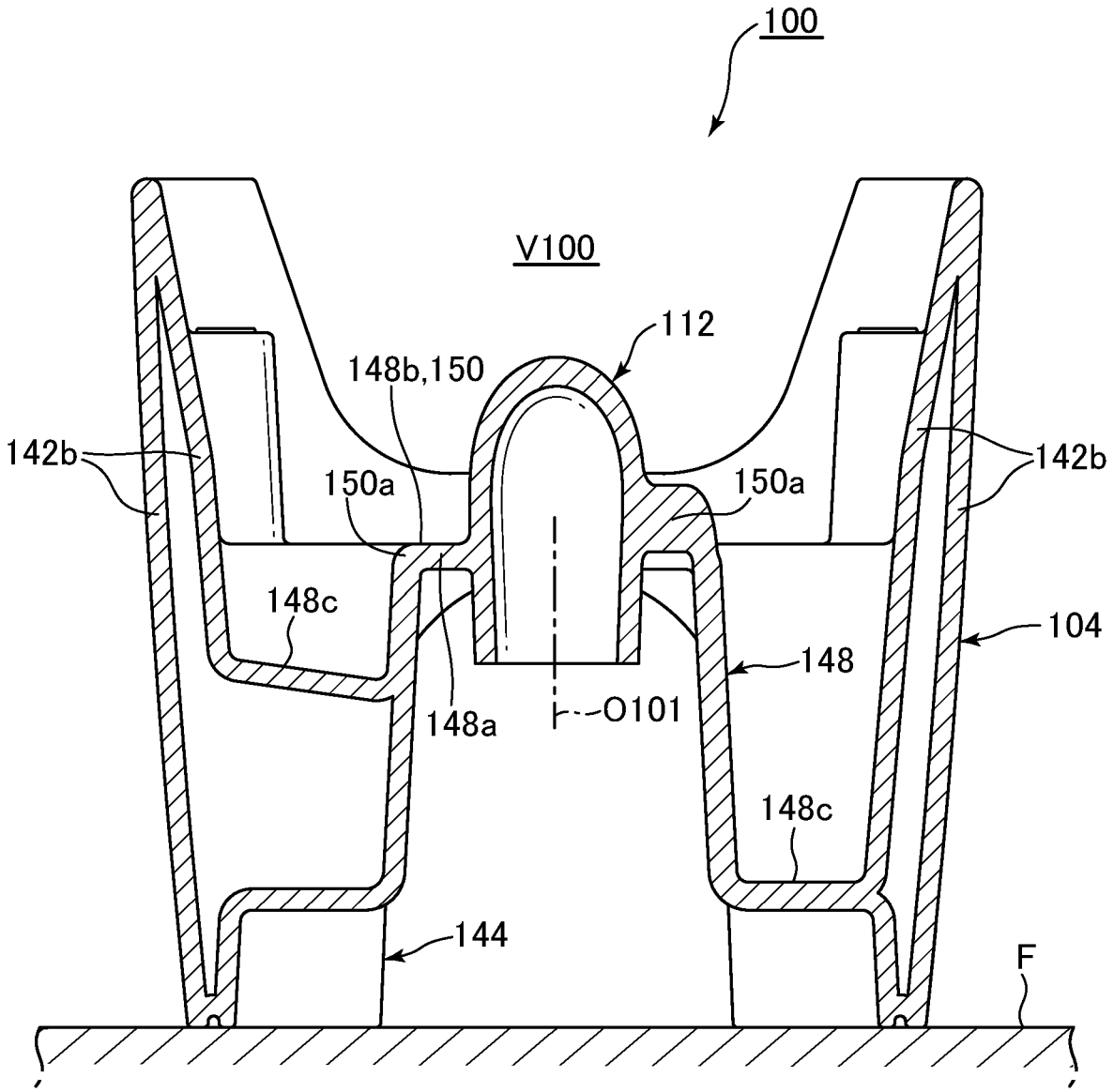
FIG. 11 is a cross-sectional view taken along a line XI-XI of FIG. 8.

Further, as shown in FIGS. 8 and 9, a width L101 of the rear horizontal wall 152 in the left-right direction is set to be larger than a maximum width L102 of an opening 144 in the left-right direction (L101>L102). Also, as shown in FIGS. 9 and 10, above the rear wall 142*a* of the skirt 142, an upper opening 146 for accessing the rear storage V100 from outside is provided. Moreover, the upper opening 146 is provided in such a manner that a width L103 of a bottom side of the opening (a lowermost end portion 146*a* of the opening 146) in the left-right direction is smaller than the width L101 of the rear horizontal wall 152 in the left-right direction (L103<L101). Furthermore, the upper opening is provided in such a manner that a width L104 between uppermost ends 146*b* of the upper opening 146 in the left-right direction is larger than the width L101 of the rear horizontal wall 152 in the left-right direction (L104>L101). Consequently, in plan view shown in FIG. 8, the horizontal wall 148*b* of the supporting wall 148 of the flush toilet 100 in the present embodiment forms a substantially T-shape together with the horizontal main wall 150 extending in a front-rear direction and the horizontal auxiliary wall (rear horizontal wall 152) extending in the left-right direction, and the horizontal wall has a structure different from that of the horizontal wall 48*b* of the supporting wall 48 in the first embodiment of the present invention.

According to the flush toilet 100 in the second embodiment of the present invention, the opening 144 in the rear wall 142*a* of the skirt 142 and a peripheral portion of the opening are likely to decrease in strength due to a space of the opening 144 and are thus likely to cause deformation such as distortion. However, in the flush toilet 100 of the present embodiment, the width L101 of the rear horizontal wall 152 in the left-right direction that is joined to the rear wall 142*a* of the skirt 142 is set to be larger than the maximum width L102 of the opening 144 in the left-right direction. Consequently, the deformation, such as the distortion, can be suppressed in the opening 144 in the rear wall 142*a* of the skirt 142 or the peripheral portion of the opening. Also, a larger size of the opening 144 in the rear wall 142*a* of the skirt 142 can be acquired, while suppressing decrease in strength of the water discharge trap 112. Further, as shown in FIGS. 9 and 10, above the rear wall 142*a* of the skirt 142, the upper opening 146 for accessing the rear storage V100 from outside is provided. Also, the upper opening 146 is provided in such a manner that the width L103 of the bottom side of the opening (the lowermost end portion 146*a* of the opening 146) in the left-right direction is smaller than the width L101 of the rear horizontal wall 152 in the left-right direction (L103<L101). Furthermore, the upper opening is provided in such a manner that the width L104 between the uppermost ends 146*b* of the upper opening 146 in the left-right direction is larger than the width L101 of the rear horizontal wall 152 in the left-right direction (L104>L101). Consequently, also in the upper opening 146, the bottom side of the upper opening 146 (the lowermost end portion 146*a* of the opening 146) close to the supporting wall 148 is smaller than the width L101 of the rear horizontal wall 152 in the left-right direction, so that the deformation, such as the distortion, can be suppressed in the upper opening 146 or a peripheral portion of the opening. Also, the maximum width L104 above the upper opening 146 is acquired to be larger than the width L101 of the rear horizontal wall 152 in the left-right direction, so that a large opening cross-sectional area of the upper opening 146 can be acquired, while suppressing deformation such as distortion of the bottom side of the upper opening 146 with the supporting wall 148.

According to the flush toilet 100 of the present embodiment, the horizontal main wall 150 in the horizontal wall 148*b* of the supporting wall 148 of the rear storage V100 of the toilet main body 104 can be provided to extend rearward from the rear side of the discharge core O101 in the water discharge trap 112. Also, between a rear end of the horizontal main wall 150 and the rear wall 142*a* of the skirt 142, the horizontal auxiliary wall (rear horizontal wall 152) that joins the rear end of the horizontal main wall and the rear wall of the skirt can be provided. Further, each of the left and right side ends 150*a* of the horizontal main wall 150 can be provided away from each of the left and right side walls 142*b* of the skirt 142. Additionally, the horizontal auxiliary wall (rear horizontal wall 152) can be provided in such a manner that each of the left and right side ends 152*a* is joined to each of the left and right side walls 142*b* of the skirt 142. Consequently, the horizontal main wall 150 can sufficiently support the left, right and rear sides of the water discharge trap 112, and the horizontal auxiliary wall (rear horizontal wall 152) can sufficiently support the horizontal main wall 150 to the rear wall 142*a* and side walls 142*b* of the skirt 142. Furthermore, the horizontal main wall 150 and horizontal auxiliary wall (rear horizontal wall 152) of the horizontal wall 148*b* of the supporting wall 148 in the rear storage V100 can acquire a region on opposite left and right sides of the horizontal main wall 150 and above the lower wall 148*c* as a comparatively large storage region.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side of side surfaces of the bowl and the water discharge trap, and a rear storage being provided below an upper end of the skirt and on an inner side than the skirt in a region more rearward than the bowl, the rear storage includes a supporting wall configured to join left and right side walls of the skirt and the water discharge trap so as to divide a storage region into upper and lower regions, the supporting wall includes a horizontal wall and left and right lower walls joined to the left and right side walls of the skirt, and the horizontal wall extends in a horizontal direction from a joining portion between the supporting wall and the water discharge trap, and the left and right lower walls are provided outside the horizontal wall in a left-right direction and below the horizontal wall, and each rear side of the left and right lower walls is separated in the left-right direction by the horizontal wall.

2. The flush toilet according to claim 1, wherein the water discharge trap includes the inlet below the bowl, and an exit provided more rearward than the inlet, and the horizontal wall includes a discharge trap vicinity region and a rear region, and the discharge trap vicinity region is provided behind and on opposite left and right sides of a discharge core that is a center of an exit side conduit in at least the water discharge trap, and the rear region is provided behind the discharge trap vicinity region and the water discharge trap.

3. The flush toilet according to claim 1, wherein the skirt includes a rear wall provided on a back surface of the toilet main body, the horizontal wall has a front side joined to a rear side of the water discharge trap, and the horizontal wall has a rear side joined to the rear wall of the skirt.

4. The flush toilet according to claim 3, wherein the rear wall of the skirt includes an opening penetrating the rear wall in a front-rear direction to communicate between the rear storage and outside of the toilet main body, the horizontal wall includes a rear horizontal wall provided on the rear side of the horizontal wall, the rear horizontal wall being joined to the rear wall of the skirt, and a width of the rear horizontal wall in a left-right direction is larger than a maximum width of the opening in the left-right direction.

5. The flush toilet according to claim 1, wherein the horizontal wall includes a horizontal main wall and a horizontal auxiliary wall, the horizontal main wall being provided to extend rearward from a rear side of a discharge core in the water discharge trap, and the horizontal auxiliary wall being provided to join a rear end of the horizontal main wall and a rear wall of the skirt, the horizontal main wall is provided in such a manner that left and right side ends of the horizontal main wall are away from the left and right side walls of the skirt in the left-right direction, respectively, and the horizontal auxiliary wall is provided in such a manner that left and right side ends of the horizontal auxiliary wall are joined to the left and right side walls of the skirt in the left-right direction, respectively.

* * * * *